US012752820B2

(12) United States Patent
Shingu

(10) Patent No.: US 12,752,820 B2
(45) Date of Patent: Oct. 6, 2026

(54) AIR CONDITIONER FOR RAILWAY VEHICLE

(71) Applicant: Mitsubishi Electric Corporation, Tokyo (JP)

(72) Inventor: Wahei Shingu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 260 days.

(21) Appl. No.: 18/548,664

(22) PCT Filed: May 13, 2021

(86) PCT No.: PCT/JP2021/018163
§ 371 (c)(1),
(2) Date: Sep. 1, 2023

(87) PCT Pub. No.: WO2022/239173
PCT Pub. Date: Nov. 17, 2022

(65) Prior Publication Data

US 2024/0149925 A1 May 9, 2024

(51) Int. Cl.
*B61D 27/00* (2006.01)

(52) U.S. Cl.
CPC ..... *B61D 27/0018* (2013.01)

(58) Field of Classification Search
CPC ..... B60H 1/00328; B61D 27/0018
See application file for complete search history.

(56) References Cited

U.S. PATENT DOCUMENTS

2020/0269885 A1 8/2020 Murakami et al.

FOREIGN PATENT DOCUMENTS

| | | | | |
|---|---|---|---|---|
| CN | 110678660 A | * | 1/2020 | ..... B60H 1/00828 |
| EP | 4261097 A1 | | 10/2023 | |
| JP | H109713 A | * | 1/1998 | |
| JP | 2005106329 A | * | 4/2005 | ..... F25B 39/04 |

(Continued)

OTHER PUBLICATIONS

International Search Report (PCT/ISA/210) with English translation and Written Opinion (PCT/ISA/237) mailed on Aug. 3, 2021, by the Japanese Patent Office as the International Searching Authority for International Application No. PCT/JP2021/018163.

(Continued)

*Primary Examiner* — Allen R. B. Schult
(74) *Attorney, Agent, or Firm* — Buchanan Ingersoll & Rooney PC

(57) ABSTRACT

Each of the first outdoor heat exchanger and the second outdoor heat exchanger includes a body including a stacked structure in which refrigerant pipes and fins are alternately stacked in a direction perpendicular to a thickness direction in which airflow passes through the first outdoor heat exchanger or the second outdoor heat exchanger. Each refrigerant pipe internally defines a plurality of refrigerant flow paths arranged in the thickness direction. A first header pipe connects the refrigerant flow paths in each refrigerant pipe to one another at a first end of the body in a length direction of the refrigerant pipes. A second header pipe connects the refrigerant flow paths in each refrigerant pipe to one another at a second end of the body in the length direction of the refrigerant pipes.

7 Claims, 9 Drawing Sheets

(56) References Cited

FOREIGN PATENT DOCUMENTS

| | | | |
|---|---|---|---|
| JP | 2007327653 | A | 12/2007 |
| JP | 2020003209 | A | 1/2020 |
| WO | 2019039401 | A1 | 2/2019 |
| WO | 2019150864 | A1 | 8/2019 |

OTHER PUBLICATIONS

Extended European Search Report dated Jun. 27, 2024, issued in the corresponding European Patent Application No. 21941907.4, 9 pages.
Communication pursuant to Article 94(3) EPC dated Jun. 29, 2026, issued in the corresponding European Patent Application No. 21941907.4. (6 pages).

* cited by examiner

AIR CONDITIONER FOR RAILWAY VEHICLE

TECHNICAL FIELD

The present disclosure relates to an air conditioner for a railway vehicle.

BACKGROUND ART

A passenger compartment of a railway vehicle is air-conditioned with a refrigeration cycle, similarly to a passenger compartment of an automobile. Although a passenger compartment of an automobile can be air-conditioned with a single refrigeration cycle system, a passenger compartment of a railway vehicle that is much larger than a passenger compartment of an automobile uses at least two refrigeration cycle systems for air conditioning. A passenger compartment of a railway vehicle is thus air-conditioned with an air conditioner for a railway vehicle including at least a pair of heat exchangers.

Patent Literature 1 describes a layout of a pair of heat exchangers in an air conditioner for a railway vehicle. As described in Patent Literature 1, the pair of heat exchangers face each other across a blower. The blower generates airflow passing through each heat exchanger in the thickness direction of the heat exchanger.

CITATION LIST

Patent Literature

Patent Literature 1: Unexamined Japanese Patent Application Publication No. 2007-327653

SUMMARY OF INVENTION

Technical Problem

Each heat exchanger in Patent Literature 1 includes multiple refrigerant pipes inside at different positions in the thickness direction of the heat exchanger. The refrigerant pipes are serially connected. In each heat exchanger in Patent Literature 1, the refrigerant thus sequentially passes through the refrigerant pipes that are at different positions in the thickness direction. More specifically, the refrigerant passes through the refrigerant pipes from one end to the other end in the thickness direction.

Each heat exchanger in Patent Literature 1 is thus placed to have either the refrigerant passing through the refrigerant pipes in the direction opposite to the airflow passing through the heat exchanger (hereafter referred to as being in an opposite placement) or the refrigerant passing through the refrigerant pipes in the direction parallel to the airflow passing through the heat exchanger (hereafter referred to as being in a parallel placement).

The opposite placement yields higher heat-exchange efficiency than the parallel placement. Although the pair of heat exchangers may both be in the opposite placement, the heat exchangers in the opposite placement are mirror symmetric across a blower and cannot have the same structure. In other words, the pair of heat exchangers have different specifications.

When the pair of heat exchangers across the blower have the same specifications, one of the heat exchangers is in the opposite placement and the other in the parallel placement. The other heat exchanger may thus have lower heat-exchange efficiency.

Although the pair of heat exchangers in Patent Literature 1 are to be in the opposite placement and have different specifications to avoid lower heat-exchange efficiency as described above, such two heat exchangers with different specifications can increase the costs of air conditioners for railway vehicles and increase difficulty in manufacturing the air conditioners. The above issues, uncommon to the air conditioner for an automobile that includes a single refrigeration cycle, occur to the air conditioner for a railway vehicle that includes a pair of heat exchangers facing each other.

An objective of the present disclosure is to provide an air conditioner for a railway vehicle that is easily manufactured at low costs.

Solution to Problem

An air conditioner for a railway vehicle according to an aspect of the present disclosure includes a first heat exchanger and a second heat exchanger facing each other, and a blower located between the first heat exchanger and the second heat exchanger and configured to generate airflow passing through the first heat exchanger and the second heat exchanger. Each of the first heat exchanger and the second heat exchanger includes a body including a stacked structure in which refrigerant pipes and fins are alternately stacked in a direction perpendicular to a thickness direction in which the airflow passes through the first heat exchanger or the second heat exchanger. Each of the refrigerant pipes internally defines a plurality of refrigerant flow paths. The plurality of refrigerant flow paths in each of the refrigerant pipes are arranged in the thickness direction. Each of the first heat exchanger and the second heat exchanger includes a first header pipe located at a first end of the body in a length direction of the refrigerant pipes. The first header pipe connects the plurality of refrigerant flow paths in each of the refrigerant pipes to one another at the first end. Each of the first heat exchanger and the second heat exchanger includes a second header pipe located at a second end of the body in the length direction of the refrigerant pipes. The second header pipe connects the plurality of refrigerant flow paths in each of the refrigerant pipes to one another at the second end.

Advantageous Effects of Invention

In the above structure, each of the first heat exchanger and the second heat exchanger includes the refrigerant pipes each defining the plurality of refrigerant flow paths that are connected to one another at both ends in the length direction of the refrigerant pipes. In other words, the refrigerant flow paths in each refrigerant pipe arranged in the thickness direction are connected in parallel. The refrigerant thus passes through the plurality of refrigerant flow paths in parallel, instead of passing through the paths in sequence.

The first heat exchanger is less likely to have a change in the heat-exchange efficiency between when placed to allow airflow from a first end to a second end in the thickness direction of the first heat exchanger and when placed to allow airflow from the second end to the first end in the thickness direction of the first heat exchanger. Similarly, the second heat exchanger is less likely to have a change in the heat-exchange efficiency between when placed to allow airflow from a first end to a second end in the thickness direction of the second heat exchanger and when placed to allow airflow from the second end to the first end in the thickness direction of the second heat exchanger.

The first heat exchanger and the second heat exchanger having the same specifications can avoid lower heat-exchange efficiency of one of the first heat exchanger or the second heat exchanger that results from the directions of the airflow passing through the first heat exchanger and the second heat exchanger. The air conditioner for a railway vehicle including the first heat exchanger and the second heat exchanger having the same specifications can be easily manufactured at low costs.

DESCRIPTION OF EMBODIMENTS

Figure 1:
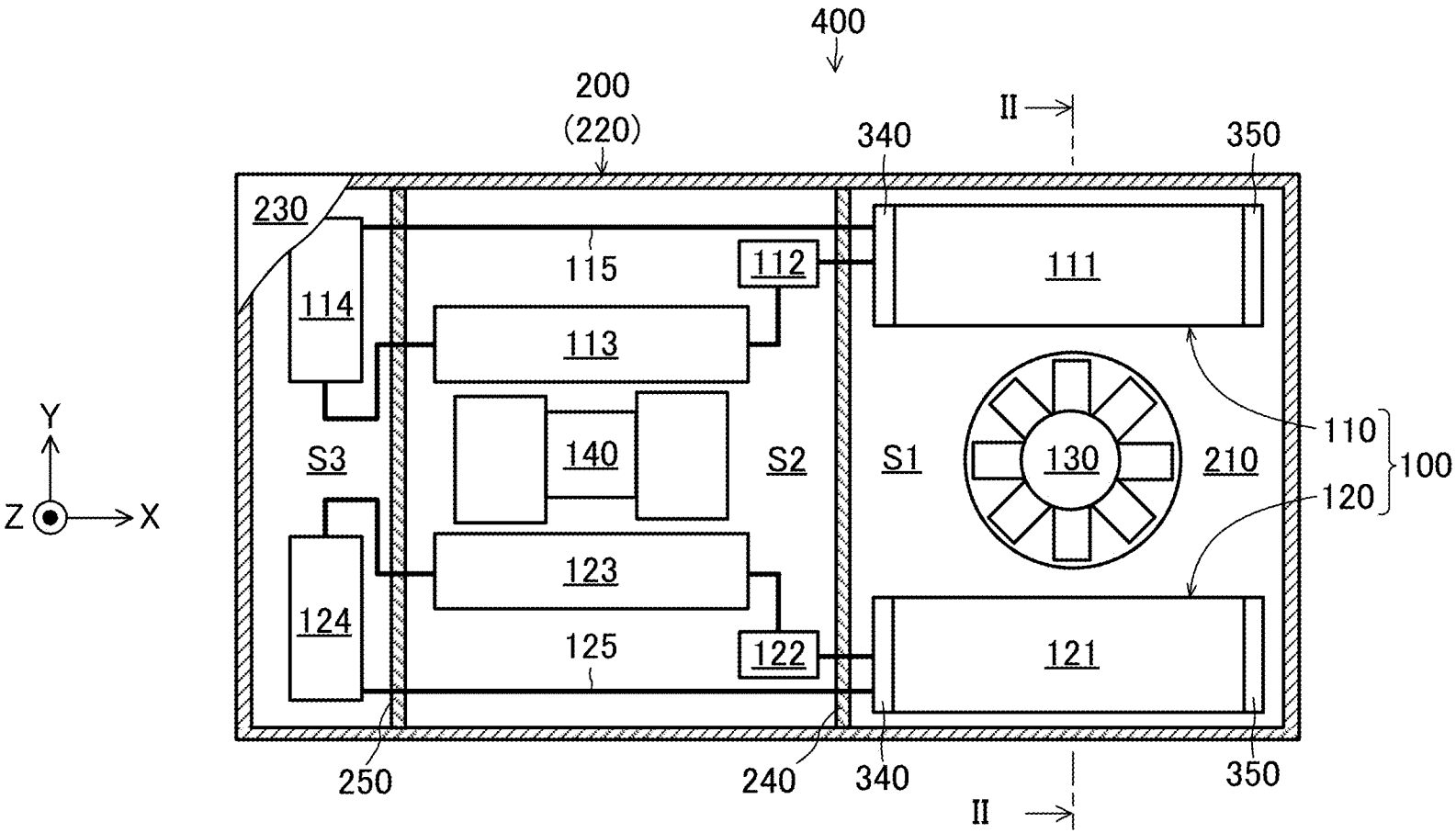
FIG. 1 is a schematic diagram of an air conditioner for a railway vehicle according to an embodiment.

An air conditioner for a railway vehicle according to an embodiment is described below with reference to the drawings. In the drawings, the same reference signs denote the same or corresponding components.

As illustrated in FIG. 1, an air conditioner 400 for a railway vehicle according to the present embodiment includes an air-conditioning device 100 that air-conditions a passenger compartment of a railway vehicle, and a housing 200 accommodating the air-conditioning device 100. The air-conditioning device 100 and the housing 200 are located on the roof of the railway vehicle.

The air-conditioning device 100 provides two refrigeration cycles. More specifically, the air-conditioning device 100 includes a refrigeration cycle system 110 that provides a first refrigeration cycle and a refrigeration cycle system 120 that provides a second refrigeration cycle.

The refrigeration cycle system 110 includes a first outdoor heat exchanger 111 serving as a condenser that condenses the refrigerant and a first cooperative device that provides the first refrigeration cycle in cooperation with the first outdoor heat exchanger 111. The first cooperative device includes a first expander 112 that expands the refrigerant condensed by the first outdoor heat exchanger 111, a first indoor heat exchanger 113 serving as an evaporator that evaporates the expanded refrigerant, and a first compressor 114 that compresses the evaporated refrigerant to return the refrigerant to the first outdoor heat exchanger 111.

The refrigeration cycle system 110 also includes a first connection pipe 115 through which the refrigerant flows. The first connection pipe 115 connects the first outdoor heat exchanger 111, the first expander 112, the first indoor heat exchanger 113, and the first compressor 114 to form a closed circuit.

Similarly, the refrigeration cycle system 120 includes a second outdoor heat exchanger 121 serving as a condenser that condenses the refrigerant and a second cooperative device that provides the second refrigeration cycle in cooperation with the second outdoor heat exchanger 121. The second cooperative device includes a second expander 122 that expands the refrigerant condensed by the second outdoor heat exchanger 121, a second indoor heat exchanger 123 serving as an evaporator that evaporates the expanded refrigerant, and a second compressor 124 that compresses the evaporated refrigerant to return the refrigerant to the second outdoor heat exchanger 121.

The refrigeration cycle system 120 also includes a second connection pipe 125 through which the refrigerant flows. The second connection pipe 125 connects the second outdoor heat exchanger 121, the second expander 122, the second indoor heat exchanger 123, and the second compressor 124 to form a closed circuit.

The air-conditioning device 100 also includes an outdoor blower 130. The outdoor blower 130 promotes heat exchange between the first outdoor heat exchanger 111 and air outside the vehicle or outside air and heat exchange between the second outdoor heat exchanger 121 and outside air. The air-conditioning device 100 also includes an indoor blower 140. The indoor blower 140 promotes heat exchange between the first indoor heat exchanger 113 and air in the passenger compartment and heat exchange between the second indoor heat exchanger 123 and air in the passenger compartment.

The housing 200 includes a box-shaped base frame 220 having a bottom plate 210 and atop plate 230 covering an upper opening of the base frame 220. In FIG. 1, a part of the top plate 230 is illustrated to indicate the inside of the housing 200.

For ease of explanation, a right-handed XYZ orthogonal coordinate system is defined with X-axis parallel to the length direction of the railway vehicle, Y-axis parallel to the width direction of the railway vehicle, and Z-axis parallel to the height direction of the railway vehicle. A positive Z-direction corresponds to the upward direction in the height direction.

The housing 200 also includes partition walls 240 and 250 that partition the interior space defined by the base frame 220 and the top plate 230 into an outdoor-unit chamber S1 serving as a first compartment, an indoor-unit chamber S2 serving as a second compartment, and a compressor chamber S3. The outdoor-unit chamber S1, the indoor-unit chamber S2, and the compressor chamber S3 are arranged in X-direction.

The outdoor-unit chamber S1 accommodates the first outdoor heat exchanger 111, the second outdoor heat exchanger 121, and the outdoor blower 130. The indoor-unit chamber S2 accommodates the first expander 112, the first indoor heat exchanger 113, the second expander 122, the second indoor heat exchanger 123, and the indoor blower 140. The compressor chamber S3 accommodates the first compressor 114 and the second compressor 124.

The air conditioner 400 for a railway vehicle according to the present embodiment is characterized in that the first outdoor heat exchanger 111 and the second outdoor heat exchanger 121 in the outdoor-unit chamber S1 have the same structure. The structure of the outdoor-unit chamber S1 is described in detail below.

Figure 2A:
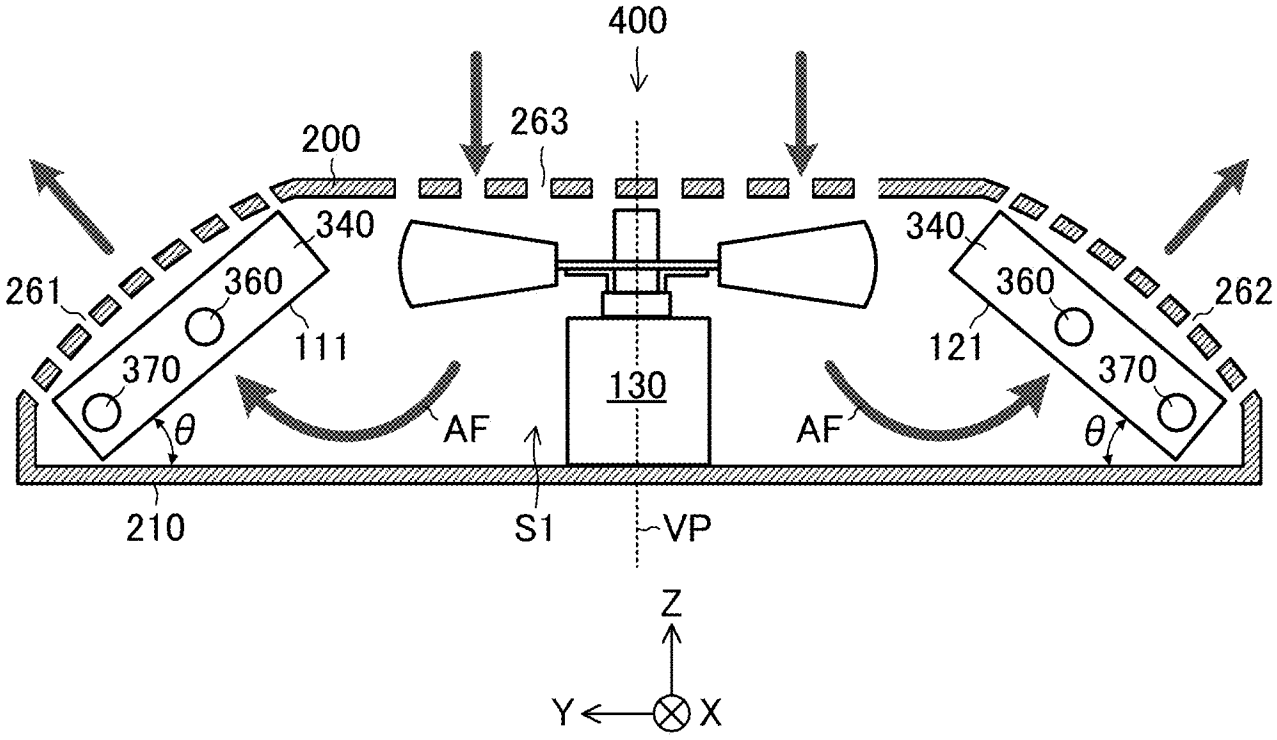
FIG. 2A is a cross-sectional view of an outdoor-unit chamber in the embodiment, as viewed in the width direction of the railway vehicle.

FIG. 2A is a cross-sectional view taken along line II-II in FIG. 1. As illustrated in FIG. 2A, the first outdoor heat exchanger 111 and the second outdoor heat exchanger 121 face each other in Y-direction. The first outdoor heat exchanger 111 and the second outdoor heat exchanger 121 are examples of a first heat exchanger and a second heat exchanger facing each other.

The outdoor blower 130 is located between the first outdoor heat exchanger 111 and the second outdoor heat exchanger 121. The outdoor blower 130 is an example of a blower located between the first heat exchanger and the second heat exchanger.

More specifically, the first outdoor heat exchanger 111 and the second outdoor heat exchanger 121 are symmetric to each other with respect to an imaginary XZ plane VP extending through the position of the outdoor blower 130. The imaginary XZ plane VP is an imaginary plane parallel to X-axis and Z-axis.

An angle θ between the first outdoor heat exchanger 111 and the bottom plate 210 is equal to an angle θ between the second outdoor heat exchanger 121 and the bottom plate 210. In the present embodiment, the angle θ is greater than or equal to 20 degrees and less than or equal to 70 degrees.

The housing 200 has first vents 261 connected outside in a portion facing the first outdoor heat exchanger 111. The housing 200 has second vents 262 connected outside in a portion facing the second outdoor heat exchanger 121. The housing 200 has third vents 263 connected outside in a portion facing the outdoor blower 130.

The outdoor blower 130 draws outside air into the outdoor-unit chamber S1 through the first vents 261 and the second vents 262 or through the third vents 263, allows the outside air drawn into the outdoor-unit chamber S1 to pass through the first outdoor heat exchanger 111 and the second outdoor heat exchanger 121, and discharges the air outside through the third vents 263 or through the first vents 261 and the second vents 262.

More specifically, the outdoor blower 130 draws outside air into the outdoor-unit chamber S1 through the third vents 263 to generate airflow AF in the outdoor-unit chamber S1. The airflow AF passes through each of the first outdoor heat exchanger 111 and the second outdoor heat exchanger 121 in the thickness direction and then flows out through the first vents 261 and the second vents 262.

A comparative example as an example known technique is described below for the issues to be solved with the structure according to the present embodiment.

Figure 7:
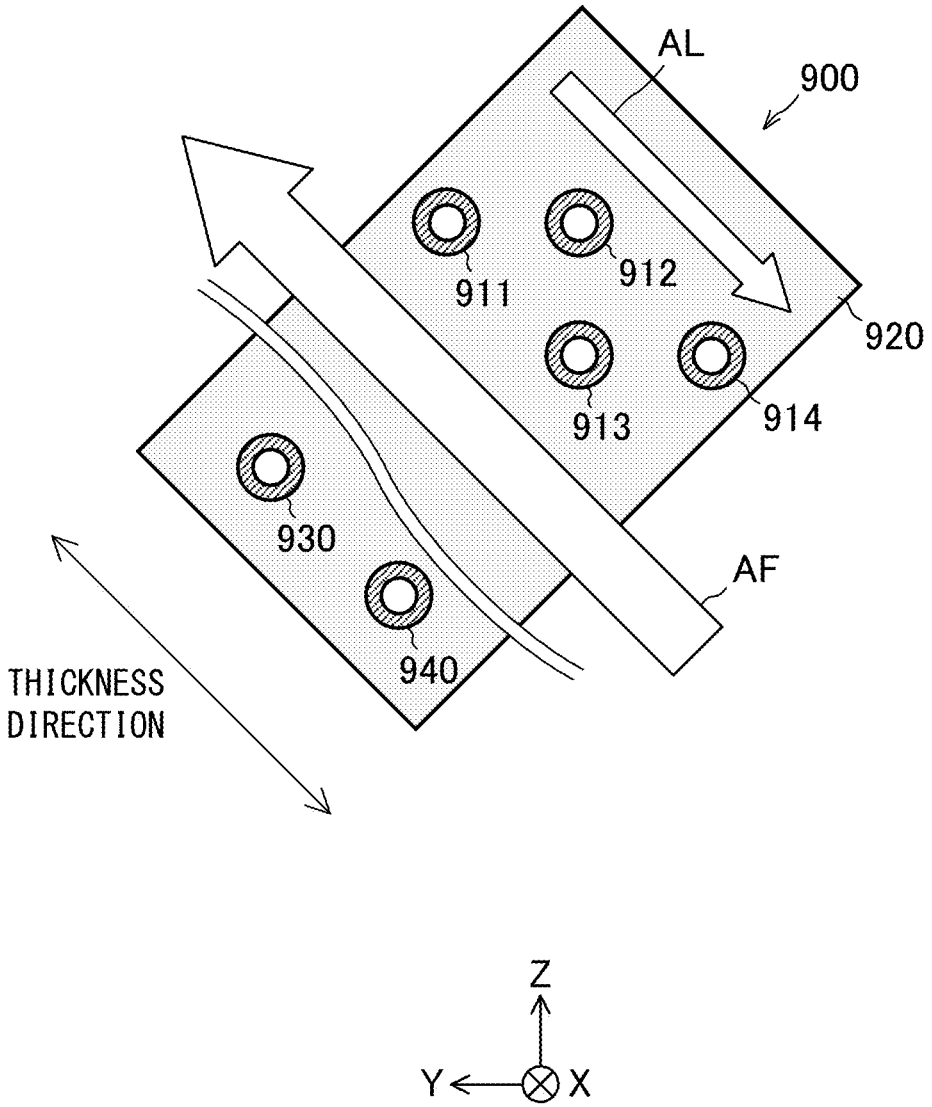
FIG. 7 is a schematic cross-sectional view of a first outdoor heat exchanger in a comparative example.

FIG. 7 illustrates the structure in the comparative example corresponding to the first outdoor heat exchanger 111 in FIG. 2A. A first outdoor heat exchanger 900 in the comparative example includes multiple refrigerant pipes 911, 912, 913, and 914, and fins 920 that are thermally connected to the refrigerant pipes 911 to 914. The refrigerant pipes 911 to 914 are at different positions in the thickness direction in which airflow AF passes through the first outdoor heat exchanger 900.

The first outdoor heat exchanger 900 includes an inlet 930 through which the refrigerant to be used for heat exchange by the first outdoor heat exchanger 900 flows in, and an outlet 940 through which the refrigerant used for heat exchange by the first outdoor heat exchanger 900 flows out. The inlet 930 and the outlet 940 are at different positions in the thickness direction.

The multiple refrigerant pipes 911 to 914 are serially interconnected at turns (not illustrated) located at both ends in X-direction. The refrigerant thus sequentially passes through the refrigerant pipes 911 to 914 at different positions in the thickness direction. More specifically, the refrigerant sequentially passes through the refrigerant pipes 911, 912, 913, and 914 in this order. Arrow AL indicates the direction in which the refrigerant passes through the refrigerant pipes.

The first outdoor heat exchanger 900 is in an opposite placement that allows the direction indicated by arrow AL to be opposite to the direction of the airflow AF passing through the first outdoor heat exchanger 900. Similarly, a second outdoor heat exchanger (not illustrated) in the comparative example facing the first outdoor heat exchanger 900 is to be in the opposite placement. The opposite placement can yield higher heat-exchange efficiency than a parallel placement that allows the direction indicated by arrow AL to be parallel to the direction of the airflow AF.

When the first outdoor heat exchanger 900 and the second outdoor heat exchanger (not illustrated) are both in the opposite placement, the first outdoor heat exchanger 900 and the second outdoor heat exchanger (not illustrated) are to be mirror symmetric to each other. In other words, the first outdoor heat exchanger 900 and the second outdoor heat exchanger (not illustrated) cannot be congruent.

More specifically, with known techniques, the first outdoor heat exchanger 900 and the second outdoor heat exchanger (not illustrated) have different specifications to have both the heat exchangers in the opposite placement. Such two outdoor heat exchangers with different specifications increase the costs of air conditioners 400 for railway vehicles and increase difficulty in manufacturing the air conditioners 400.

The first outdoor heat exchanger 900 and the second outdoor heat exchanger (not illustrated) may have the same specifications when one the first outdoor heat exchanger 900 or the second outdoor heat exchanger is in the opposite placement and the other in the parallel placement. However, the first outdoor heat exchanger 900 or the second outdoor heat exchanger (not illustrated) in the parallel placement may have lower heat-exchange efficiency.

The present embodiment is directed to the issues of avoiding lower heat-exchange efficiency that results from the directions of airflow AF and allowing the first outdoor heat exchanger 111 and the second outdoor heat exchanger 121 to have the same specifications.

The present embodiment directed to the above issues is described below. The first outdoor heat exchanger 111 is described below. The second outdoor heat exchanger 121 has the same structure as the first outdoor heat exchanger 111.

Figure 3:
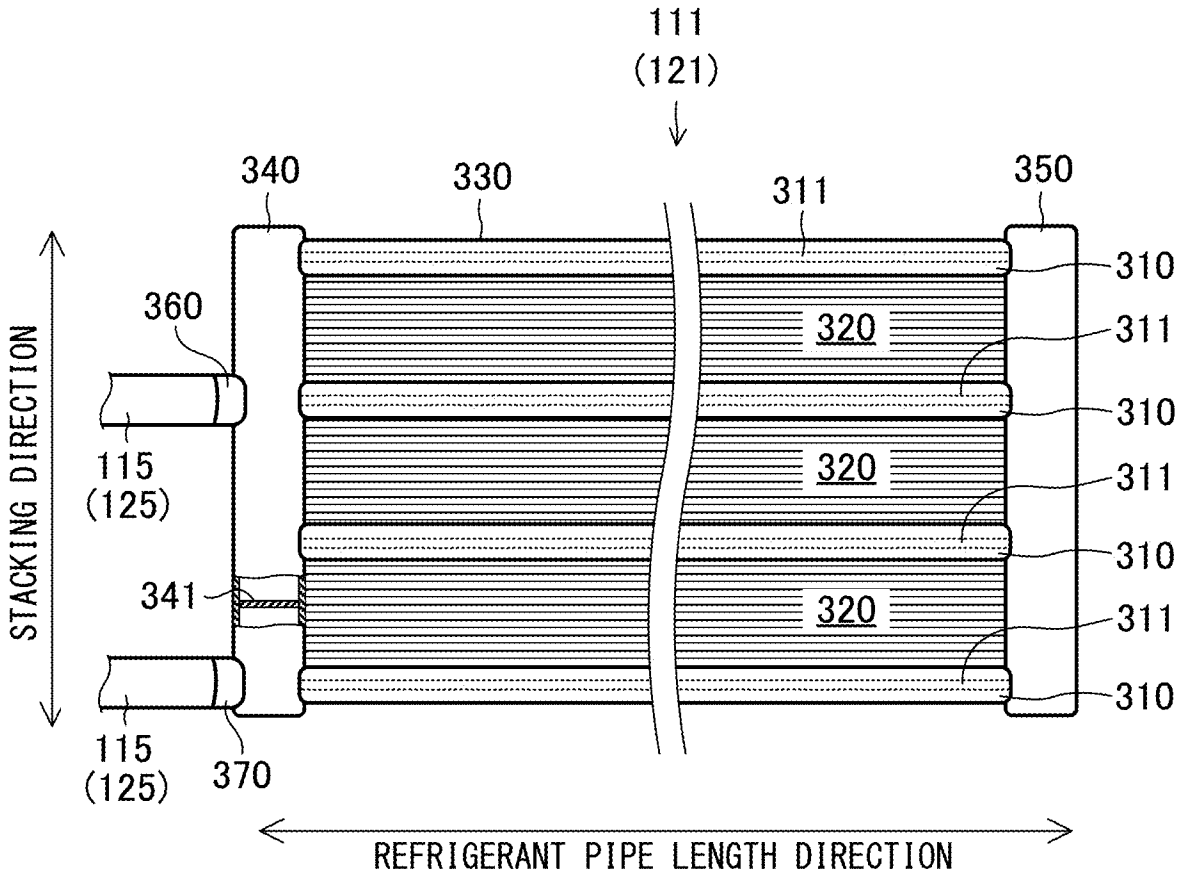
FIG. 3 is a side view of a first outdoor heat exchanger in the embodiment, as viewed in the thickness direction.

FIG. 3 is a side view of the first outdoor heat exchanger 111 in the present embodiment, as viewed in the thickness direction in which the airflow AF passes through the first outdoor heat exchanger 111. As illustrated in FIG. 3, the first outdoor heat exchanger 111 includes a body 330. The body 330 includes a stacked structure in which refrigerant pipes 310 and fins 320 are alternately stacked. The refrigerant flows through the refrigerant pipes 310.

In the body 330, the refrigerant pipes 310 and the fins 320 are stacked in the direction (hereafter referred to as a stacking direction) perpendicular to a length direction (hereafter referred to as a refrigerant pipe length direction) of the refrigerant pipes 310 and to the thickness direction in which the airflow AF illustrated in FIG. 2A passes through the first outdoor heat exchanger 111.

Each refrigerant pipe 310 internally defines multiple refrigerant flow paths 311. The refrigerant flows through the refrigerant flow paths 311. The refrigerant flow paths 311 in the refrigerant pipes 310 are arranged in the thickness direction perpendicular to the page of FIG. 3.

Each fin 320 is brazed to adjacent ones of the refrigerant pipes 310 in the stacking direction. Each fin 320 is thus thermally connected to the adjacent refrigerant pipes 310 in the stacking direction. More specifically, each fin 320 is a corrugated fin being a metal plate folded in a wave shape.

The first outdoor heat exchanger 111 includes a first header pipe 340 located at one end of the body 330 in the refrigerant pipe length direction and a second header pipe 350 located at the other end of the body 330 in the refrigerant pipe length direction. The first header pipe 340 and the second header pipe 350 extend in the stacking direction.

The first header pipe 340 connects the refrigerant flow paths 311 in each refrigerant pipe 310 to one another at one end in the refrigerant pipe length direction. The second header pipe 350 connects the refrigerant flow paths 311 in each refrigerant pipe 310 to one another at the other end in the refrigerant pipe length direction. The refrigerant flow paths 311 arranged in the thickness direction in each refrigerant pipe 310 are thus connected in parallel to one another.

The first header pipe 340 includes an inlet 360 through which the refrigerant to be used by the first outdoor heat exchanger 111 for heat exchange flows in, and an outlet 370 through which the refrigerant used by the first outdoor heat exchanger 111 for heat exchange flows out.

The inlet 360 and the outlet 370 face each other in the stacking direction. The first connection pipe 115 illustrated also in FIG. 1 is connected to the inlet 360 and the outlet 370. More specifically, the first header pipe 340 allows the refrigerant to flow into and out of the first outdoor heat exchanger 111.

The first header pipe 340 includes a partition 341 that blocks the refrigerant between the inlet 360 and the outlet 370 in the stacking direction. The direction from the partition 341 toward the inlet 360 in the stacking direction is defined as a positive stacking direction, and the direction from the partition 341 toward the outlet 370 in the stacking direction is defined as a negative stacking direction.

The refrigerant flows from the first header pipe 340 toward the second header pipe 350 through the refrigerant flow paths 311 in the refrigerant pipes 310 located in the positive stacking direction from the partition 341. The refrigerant flows from the second header pipe 350 toward the first header pipe 340 through the refrigerant flow paths 311 in the refrigerant pipes 310 located in the negative stacking direction from the partition 341.

Figure 4:
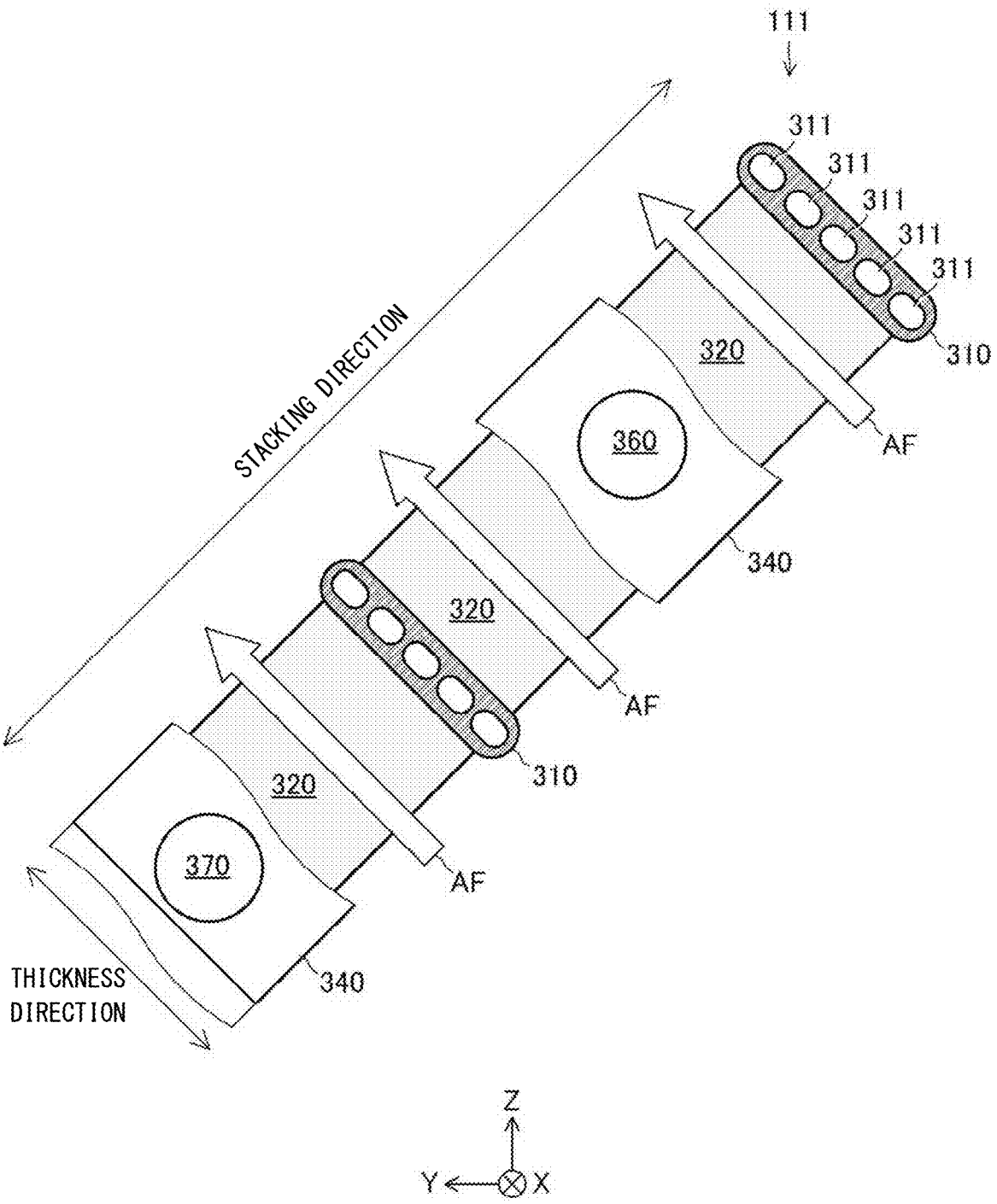
FIG. 4 is a partial cross-sectional view of the first outdoor heat exchanger in the embodiment, as viewed in the length direction of refrigerant pipes.

FIG. 4 is a partial cross-sectional view of the first outdoor heat exchanger 111 as viewed in a direction parallel to the thickness direction and the stacking direction. Each refrigerant pipe 310 includes the refrigerant flow paths 311 arranged in the thickness direction of the first outdoor heat exchanger 111. Each refrigerant pipe 310 thus has, as viewed in a direction parallel to a YZ plane, a cross section that is flat and elongated in one direction, or more specifically, in the thickness direction of the first outdoor heat exchanger 111. As described above, the refrigerant flow paths 311 arranged in the thickness direction are connected in parallel to one another. Thus, unlike in the structure in the comparative example, the refrigerant passes through the refrigerant flow paths 311 non-sequentially. The refrigerant passes through the refrigerant flow paths 311 in parallel in the refrigerant pipe length direction.

The first outdoor heat exchanger 111 thus has heat exchange efficiency that is less dependent on the direction of the airflow AF passing through the first outdoor heat exchanger 111 in the thickness direction. The second outdoor heat exchanger 121 and the first outdoor heat exchanger 111 having the same specifications can thus avoid lower heat-exchange efficiency of one of the first outdoor heat exchanger 111 or the second outdoor heat exchanger 121 that results from the directions of the airflow AF passing through the first outdoor heat exchanger 111 and the second outdoor heat exchanger 121.

The above structure is described more specifically with reference to FIG. 2A. As described above, the second outdoor heat exchanger 121 and the first outdoor heat exchanger 111 are symmetric to each other with respect to a plane. When the airflow AF passes through the first outdoor heat exchanger 111 from a first end to a second end in the thickness direction, the airflow AF passes through the second outdoor heat exchanger 121 having the same specifications as the first outdoor heat exchanger 111 from a second end to a first end in the thickness direction.

As described above, the first outdoor heat exchanger 111 and the second outdoor heat exchanger 121 each include the refrigerant flow paths 311 illustrated in FIG. 4 that are connected in parallel to one another. Thus, the heat exchange efficiency is dependent on the directions of the airflow AF passing through the heat exchangers. The first outdoor heat exchanger 111 and the second outdoor heat exchanger 121 having the same specifications can avoid lower heat-exchange efficiency of one of the first outdoor heat exchanger 111 or the second outdoor heat exchanger 121 that results from the directions of the airflow AF passing through the first outdoor heat exchanger 111 and the second outdoor heat exchanger 121.

The first outdoor heat exchanger 111 and the second outdoor heat exchanger 121 having the same specifications herein refer to the first outdoor heat exchanger 111 and the second outdoor heat exchanger 121 having the overall shapes of the flow paths for the refrigerant being congruent. The shapes being congruent refers to the shapes being superposable on each other imaginarily. The first outdoor heat exchanger 111 and the second outdoor heat exchanger 121 can thus have some structural differences other than in the overall shape of the flow paths for the refrigerant.

As described above, the first outdoor heat exchanger 111 and the second outdoor heat exchanger 121 can have the same specifications. Thus, the air conditioner 400 for a railway vehicle can be easily manufactured at low costs.

The relative positions of the first outdoor heat exchanger 111 and the second outdoor heat exchanger 121 are described in detail below.

As illustrated in FIG. 1, the first outdoor heat exchanger 111 and the second outdoor heat exchanger 121 are each placed with the refrigerant pipe length direction aligned with X-direction. The first header pipe 340 of the first outdoor heat exchanger 111 and the first header pipe 340 of the second outdoor heat exchanger 121 face each other in Y-direction.

The first header pipe 340 of the first outdoor heat exchanger 111 is located at an end of the first outdoor heat exchanger 111 nearer the indoor-unit chamber S2 in X-direction. Similarly, the first header pipe 340 of the second outdoor heat exchanger 121 is located at an end of the second outdoor heat exchanger 121 nearer the indoor-unit chamber S2 in X-direction. More specifically, the first header pipe 340 of the first heat exchanger 111 and the first outdoor header pipe 340 of the second outdoor heat exchanger 121 face the partition wall 240 partitioning the outdoor-unit chamber S1 and the indoor-unit chamber S2 from each other.

The first header pipe 340 that allows the refrigerant to flow into and out of the first outdoor heat exchanger 111 is located at the end in X-direction nearer the indoor-unit chamber S2. This structure reduces the path length of the first connection pipe 115 in the refrigeration cycle system 110.

The first header pipe 340 that allows the refrigerant to flow into and out of the second outdoor heat exchanger 121 is located at the end in X-direction nearer the indoor-unit chamber S2. This structure reduces the path length of the second connection pipe 125 in the refrigeration cycle system 120.

FIG. 2A also illustrates the first header pipes 340 of the first outdoor heat exchanger 111 and the second outdoor heat exchanger 121. The inlet 360 in the first outdoor heat exchanger 111 and the inlet 360 in the second outdoor heat exchanger 121 face each other in Y-direction. The outlet 370 in the first outdoor heat exchanger 111 and the outlet 370 in the second outdoor heat exchanger 121 face each other in Y-direction.

The first connection pipe 115 and the second connection pipe 125 illustrated in FIG. 1 are thus installed symmetrically with respect to the imaginary XZ plane VP. This simplifies the installation pattern of the first connection pipe 115 and the second connection pipe 125 and facilitates manufacturing of the air conditioner 400 for a railway vehicle.

The embodiment described above may be modified as described below.

Modification 1

Figure 2B:
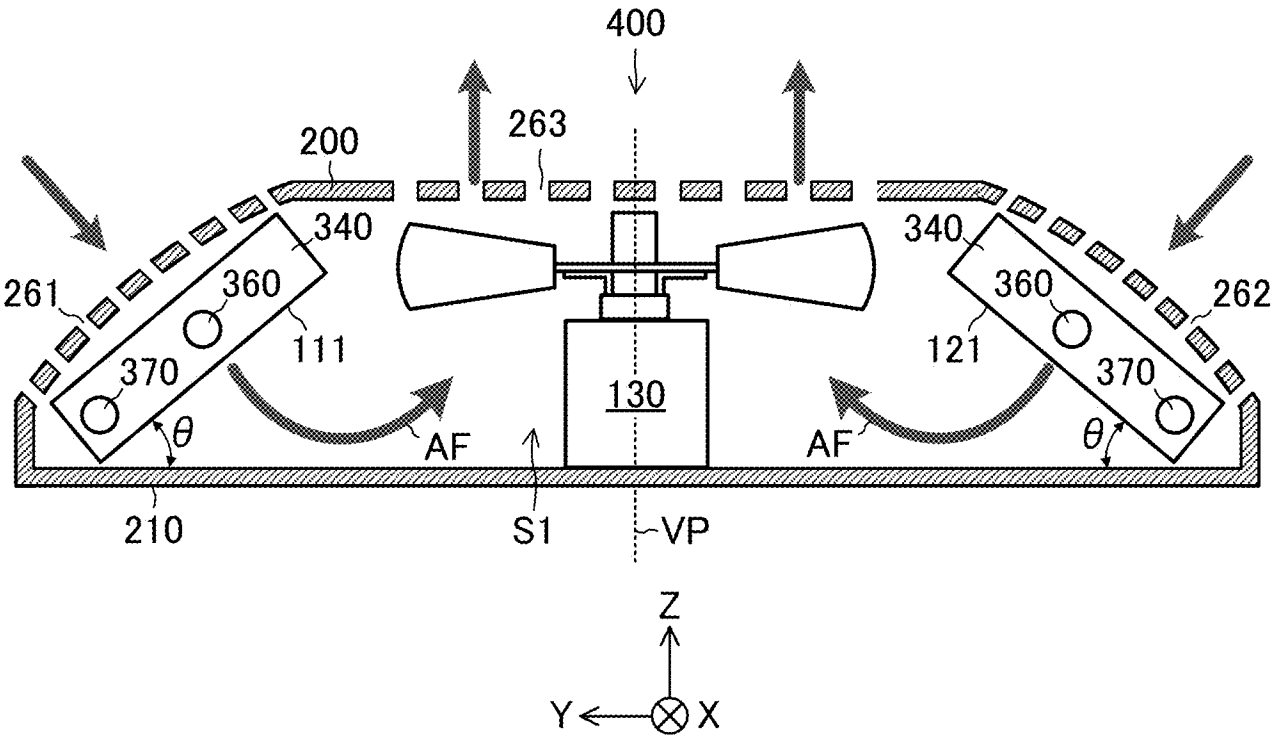
FIG. 2B is a cross-sectional view of an outdoor-unit chamber in Modification 1, as viewed in the width direction of the railway vehicle.

As illustrated in FIG. 2B, an outdoor blower 130 in Modification 1 draws outside air into the outdoor-unit chamber S1 through the first vents 261 and the second vents 262 to generate airflow AF in the outdoor-unit chamber S1. The airflow AF passes through the first outdoor heat exchanger 111 and the second outdoor heat exchanger 121 in the thickness direction and then flows out through the third vents 263.

In other words, the directions of the airflow AF in FIG. 2B is opposite to the directions of the airflow AF in FIG. 2A. The directions of the airflow AF passing through the first outdoor heat exchanger 111 and the second outdoor heat exchanger 121 in FIG. 2B is thus also opposite to the directions of the airflow AF in FIG. 2A. However, as described above, the first outdoor heat exchanger 111 and the second outdoor heat exchanger 121 with the above structure have the heat exchange efficiency that is less dependent on the directions of the airflow AF passing through the heat exchangers.

Thus, the structure for generating the airflow AF in FIG. 2A (hereafter referred to as a downward blowing structure) and the structure for generating the airflow AF in FIG. 2B (hereafter referred to as an upward blowing structure) both including the same first outdoor heat exchanger 111 and the same second outdoor heat exchanger 121 can have substantially the same heat exchange efficiency. More specifically, the first outdoor heat exchanger 111 and the second outdoor heat exchanger 121 are usable for both the downward blowing structure and the upward blowing structure. This can facilitate control of the production of the components of the air conditioner 400 for a railway vehicle. This advantageous effect is particularly produced by the air conditioner 400 for a railway vehicle with the upward blowing structure or the downward blowing structure.

Modification 2

Figure 5:
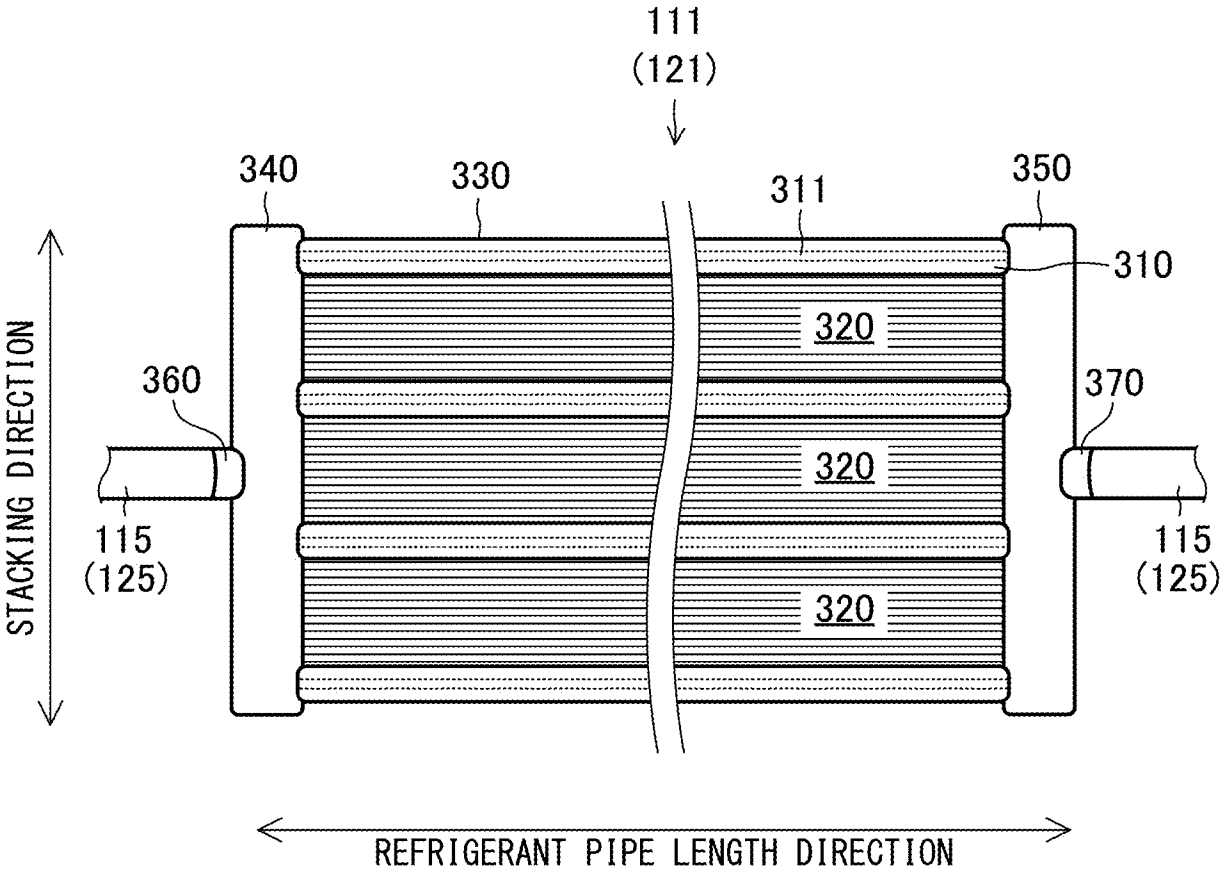
FIG. 5 is a side view of a first outdoor heat exchanger in Modification 2, as viewed in the thickness direction.

As illustrated in FIG. 5, a second header pipe 350 in each of the first outdoor heat exchanger 111 and the second outdoor heat exchanger 121 in Modification 2 has an outlet 370. As in the embodiment illustrated in FIG. 3, the inlet 360 is located in the first header pipe 340. Although the first connection pipe 115 and the second connection pipe 125 illustrated in FIG. 1 are longer in the structure in Modification 2 than in the structure in the embodiment, the refrigerant can flow at a constant rate through the multiple refrigerant pipes 310 arranged in the stacking direction.

Modifications 3 and 4

Figure 6A:
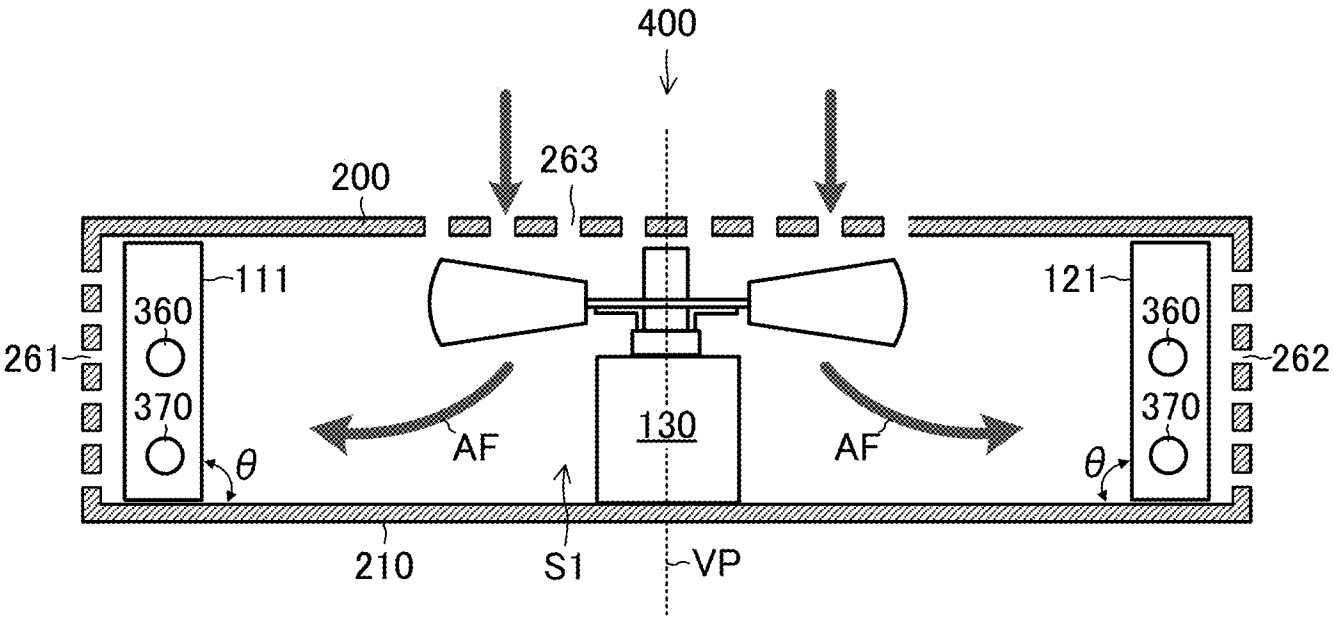
FIG. 6A is a cross-sectional view of an outdoor-unit chamber in Modification 3, as viewed in the width direction of the railway vehicle.
Figure 6B:
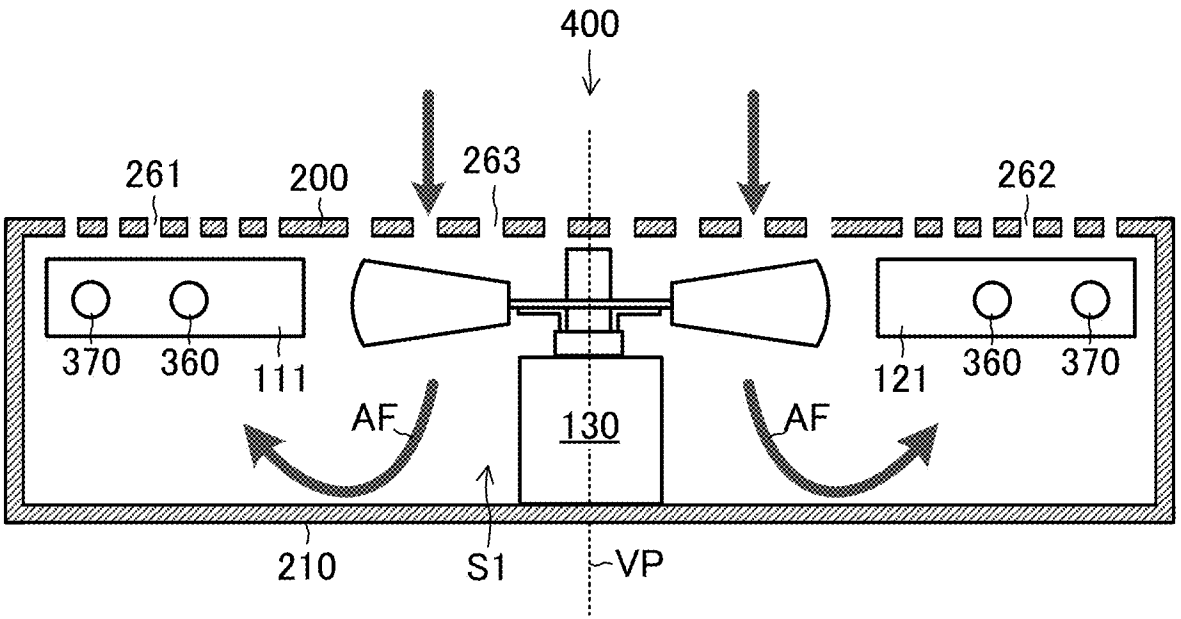
FIG. 6B is a cross-sectional view of an outdoor-unit chamber in Modification 4, as viewed in the width direction of the railway vehicle.

FIGS. 6A and 6B illustrate structures in the outdoor-unit chamber S1 in Modifications 3 and 4. In FIG. 6A, each of the first outdoor heat exchanger 111 and the second outdoor heat exchanger 121 is at an angle (hereafter referred to as an installation angle) 0 of 90 degrees with respect to the bottom plate 210. In FIG. 6B, the installation angle is 0 degrees, or more specifically, each of the first outdoor heat exchanger 111 and the second outdoor heat exchanger 121 is parallel to the bottom plate 210. The installation angle is not limited to 0 or 90 degrees, and may be greater than or equal to 0 degrees and less than or equal to 90 degrees.

Modification 5

As illustrated in FIG. 1, the indoor-unit chamber S2 has the same layout as the outdoor-unit chamber S1. More specifically, the first indoor heat exchanger 113 and the second indoor heat exchanger 123 serving as evaporators face each other, similarly to the first outdoor heat exchanger 111 and the second outdoor heat exchanger 121 serving as condensers.

The indoor blower 140 is located between the first indoor heat exchanger 113 and the second indoor heat exchanger 123. The indoor blower 140 generates airflow passing through the first indoor heat exchanger 113 and the second indoor heat exchanger 123 in the thickness direction in the indoor-unit chamber S2.

The structures illustrated in FIGS. 3 to 5 is applicable to the first indoor heat exchanger 113 and the second indoor heat exchanger 123 serving as evaporators. Water (hereafter referred to as condensate) caused by condensation adheres to the evaporators. Unlike the known refrigerant pipes 911 to 914, the refrigerant pipes 310 are flat and elongated in the thickness direction. The condensate may thus accumulate on the refrigerant pipes 310. The structures illustrated in FIGS. 3 to 5 is thus applicable to condensers rather than evaporators.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to betaken in a limiting sense, and the scope of the invention is defined only by the included claims, along with the full range of equivalents to which such claims are entitled.

REFERENCE SIGNS LIST

100 Air-conditioning device
110, 120 Refrigeration cycle system
111 First outdoor heat exchanger (first heat exchanger, condenser)
112 First expander
113 First indoor heat exchanger

114 First compressor
115 First connection pipe
121 Second outdoor heat exchanger (second heat exchanger, condenser)
122 Second expander
123 Second indoor heat exchanger
124 Second compressor
125 Second connection pipe
130 Outdoor blower (blower)
140 Indoor blower
200 Housing
210 Bottom plate
220 Base frame
230 Top plate
240, 250 Partition wall
261 First vent
262 Second vent
263 Third vent
310 Refrigerant pipe
311 Refrigerant flow path
320 Fin
330 Body
340 First header pipe
341 Partition
350 Second header pipe
360 Inlet
370 Outlet
400 Air conditioner for railway vehicle
900 First outdoor heat exchanger
911, 912, 913, 914 Refrigerant pipe
920 Fin
930 Inlet
940 Outlet
AF Airflow
AL Arrow
S1 Outdoor-unit chamber (first compartment)
S2 Indoor-unit chamber (second compartment)
S3 Compressor chamber
VP Imaginary XZ plane

The invention claimed is:

1. An air conditioner for a railway vehicle, the air conditioner comprising:

a first heat exchanger and a second heat exchanger facing each other; and a blower located between the first heat exchanger and the second heat exchanger and configured to generate airflow passing through the first heat exchanger and the second heat exchanger, each of the first heat exchanger and the second heat exchanger including a body including a stacked structure in which refrigerant pipes and fins are alternately stacked in a direction perpendicular to a thickness direction in which the airflow passes through the first heat exchanger or the second heat exchanger, each of the refrigerant pipes internally defining a plurality of refrigerant flow paths, the plurality of refrigerant flow paths in each of the refrigerant pipes being arranged in the thickness direction, a first header pipe located at a first end of the body in a length direction of the refrigerant pipes, the first header pipe connecting the plurality of refrigerant flow paths in each of the refrigerant pipes to one another at the first end, and a second header pipe located at a second end of the body in the length direction of the refrigerant pipes, the second header pipe directly connecting, entirely within a flow path in the second header pipe, the plurality of refrigerant flow paths in all of the refrigerant pipes to one another at the second end, wherein the first header pipe of the first heat exchanger has an inlet through which a refrigerant to be used by the first heat exchanger for heat exchange flows in, and an outlet through which the refrigerant used by the first heat exchanger for the heat exchange flows out, the first header pipe of the second heat exchanger has an inlet through which a refrigerant to be used by the second heat exchanger for heat exchange flows in, and an outlet through which the refrigerant used by the second heat exchanger for the heat exchange flows out, and the first header pipe of the first heat exchanger and the first header pipe of the second heat exchanger face each other.

2. The air conditioner according to claim 1, further comprising:

a housing defining a first compartment and a second compartment, the first compartment accommodating the first heat exchanger and the second heat exchanger, the second compartment accommodating a first cooperative device and a second cooperative device, the first cooperative device providing a first refrigeration cycle in cooperation with the first heat exchanger, the second cooperative device providing a second refrigeration cycle in cooperation with the second heat exchanger, the housing including a partition wall partitioning the first compartment and the second compartment from each other, wherein the first header pipe of the first heat exchanger and the first header pipe of the second heat exchanger face the partition wall.

3. The air conditioner according to claim 2, wherein the inlet of the first header pipe of the first heat exchanger and the inlet of the first header pipe of the second heat exchanger face each other, and the outlet of the first header pipe of the first heat exchanger and the outlet of the first header pipe of the second heat exchanger face each other.

4. The air conditioner according to claim 1, wherein the first heat exchanger and the second heat exchanger are condensers to condense a refrigerant.

5. The air conditioner according to claim 1, wherein the first heat exchanger and the second heat exchanger are symmetric to each other with respect to an imaginary plane extending through a position of the blower.

6. The air conditioner according to claim 1, further comprising:

a bottom plate on which the first heat exchanger, the second heat exchanger, and the blower are installed, wherein each of the first heat exchanger and the second heat exchanger is at an angle greater than or equal to 0 degrees and less than or equal to 90 degrees with respect to a surface of the bottom plate.

7. The air conditioner according to claim 1, wherein the inlet of the first header pipe of the first heat exchanger and the inlet of the first header pipe of the second heat exchanger face each other, and the outlet of the first header pipe of the first heat exchanger and the outlet of the first header pipe of the second heat exchanger face each other.

* * * * *